United States Patent [19]

Ward et al.

[11] 3,963,435

[45] June 15, 1976

[54] POLYESTER GRAFTS AND CROSSLINKS TO COTTON BY REACTION WITH HETEROCYCLIC CARBONATE, GLYCOL, AND DIBASIC ACID

[75] Inventors: Truman L. Ward; Ruth R. Benerito, both of New Orleans, La.

[73] Assignee: The United States of America as represented by the Secretary of Agriculture, Washington, D.C.

[22] Filed: Sept. 8, 1975

[21] Appl. No.: 611,373

[52] U.S. Cl. ..... 8/120; 8/129; 8/DIG. 11

[51] Int. Cl.[2] ..... D06M 11/02; D06M 13/10; D06M 13/16

[58] Field of Search ..... 8/120, 129, DIG. 11

[56] References Cited

UNITED STATES PATENTS 3,617,197 11/1971 Ulrich ..... 8/116.3

*Primary Examiner*—John Kight, III

*Attorney, Agent, or Firm*—M. Howard Silverstein

[57] ABSTRACT

Cellulosic fabric is reacted with a mixture of diethylene glycol, dibasic acid, and either ethylene carbonate (1,3 dioxol-2-one) or propylene carbonate (4-methyl 1,3 dioxol-2-one) in a heated evacuated oven. The resultant product has polyester linear grafts and crosslinks and improved resistance to wrinkling.

4 Claims, No Drawings

POLYESTER GRAFTS AND CROSSLINKS TO COTTON BY REACTION WITH HETEROCYCLIC CARBONATE, GLYCOL, AND DIBASIC ACID

This invention relates to chemical modification of fibrous cellulose by reaction with a mixture of a cyclic carbonate, a glycol and a dibasic acid. More specifically, this invention relates to the modification of cotton cellulose fabric with either propylene carbonate (4-methyl-1,3 dioxol-2- one) or ethylene carbonate (1,3 dioxol-2-one), diethylene glycol and malonic acid. The product thus produced has polyester type crosslinks and terminated linear grafts and improved resistance to wrinkling.

If cotton cellulose with its reactive hydroxyl groups is represented as Cell-OH, a schematic which would represent the pertinent reactions of this invention is this:

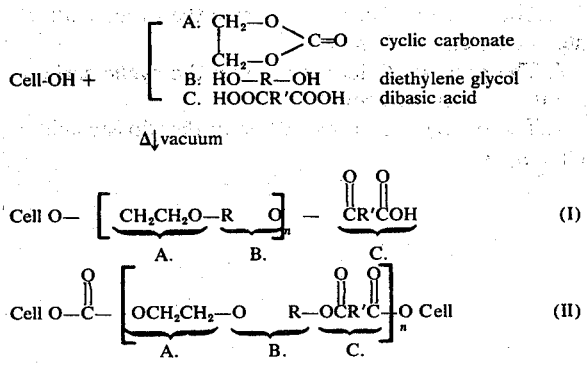

Where R is $CH_2$, R′ is $CH_2CH_2OCH_2CH_2$ and n is a whole number and where (1) is representative of terminated linear grafts and (11) is representative of polyester crosslinks between cellulosic chains.

The main object of this invention is to provide a process for reacting a cyclic carbonate, diethylene glycol and dibasic acid with unmodified cellulose which process has the capability of adding polyester chains to the cellulose as terminated linear chain grafts or as crosslinks between cellulosic hydroxyl groups.

Another objective of this invention is to provide a process for reacting cellulosic textiles with cyclic carbonates, diethylene glycol and a dibasic acid to produce fabrics having improved resistance to the retention of wrinkles.

We have now discovered that unmodified cotton cellulose in fabric form can be reacted with a mixture containing cyclic carbonate (ethylene carbonate, propylene carbonate or a mixture of these), diethylene glycol, and malonic acid to produce modified cotton cellulose having polyester groups attached. The reaction proceeds in a heated vacuum oven without catalyst to yield a product with improved resistance to wrinkling.

By the process of this invention, the cellulose fabric is padded to 100% takeup of a solution containing about 50 parts (by weight) each of the cyclic carbonate and diethylene glycol and about 1 part of malonic acid. The cyclic carbonate may be either propylene or ethylene carbonate or a mixture of the two. Malonic acid is preferred because it is soluble in the other constituents. Other dibasic acids that are soluble in the mixture of the glycol and cyclic carbonate would be expected to react in a similar manner. Ethylene glycol does not work as well in this process as does diethylene glycol.

Diethylene glycol has almost the identical boiling point of either ethylene carbonate or propylene carbonate but the boiling point of ethylene glycol is about 50°C lower.

By the process of this invention the padded fabric is placed while wet with the solution of the invention into a heated vacuum oven. The preferred temperature is from about 160° to 180°C. Temperatures above 180°C discolor the fabric and temperatures below 160°C require too long for reaction. By the process of this invention the heated oven containing the fabric is evacuated to a pressure of about 35 mm of mercury (Hg) and the evacuation continued during the reaction period. This process of heat and vacuum not only induces reaction but, removes water produced in the condensation reaction which removal is necessary for the reaction to continue. By the process of this invention the vacuum and heat are maintained for about from 30 to 120 minutes after which the vacuum is released, the sample removed from the oven and washed with water to remove unreacted material. The following examples illustrate the invention:

EXAMPLE 1

Unmodified cotton fabric was padded to 100% takeup in a solution of 50 parts propylene carbonate, 50 parts diethylene glycol, 1 part of malonic acid. The wetted fabric was placed in a vacuum oven preheated to 180°C. The oven was evacuated to a pressure of 35 mm mercury (Hg), and the temperature and vacuum maintained at 180°C for 60 minutes. At the end of the 60 minutes reaction period the vacuum was released, the fabric sample was removed, washed and dried. The fabric had gained 0.2% weight. Infrared spectra indicated that ester groups had been added. The dry wrinkle recovery value had increased from 181° to 241 (W+F)° and wet wrinkle recovery had increased from 182 to 201 (W+F)° as measured by ASTM test specification D-1295-67, Philadelphia, Pa., 1967. The fabric color was not changed by the reaction. Control indicated that all three of the components are necessary to the process.

EXAMPLE 2

The same procedure and materials were used as in Example 1 except that ethylene carbonate was substituted for propylene carbonate. The resultant fabric had dry wrinkle recovery value of 235 (W+F)° and a wet wrinkle recovery of 210 (W+F)° . Other results were the same as Example 1.

EXAMPLE 3

The same procedure and materials were used as in Example 1 except that the reaction was carried out for 30 minutes rather than 60 minutes. The resultant fabrics had a dry wrinkle recovery value of 215 (W+f)° and wet wrinkle recovery of 195 (W+F)° . Other results were the same as Example 1.

EXAMPLE 4

The same procedure and materials were used as in Example 1 except that the reaction was carried out for 120 minutes rather than 60 minutes. The resultant fabrics had a dry wrinkle recovery value of 238 (W+F)° and wet wrinkle recovery of 210 (W+F)° . Other results were the same as Example 1.

EXAMPLE 5

The same procedure and materials were used as in Example 1 except that the reaction temperature was 160°C rather than 180°C. The resultant fabric had dry wrinkle recovery value of 220 (W+F)° and wet wrinkle recovery of 200 (W+F)°. Other results were the same as Example 1.

EXAMPLE 6

The same procedure and materials were used as in Example 1 except that the reaction temperature was 200°C rather than 180°C. The resultant fabric had a dry wrinkle recovery value of 250 (W+F)° and wet wrinkle recovery of 215 (W+F)°. The sample was brown in appearance. This temperature was higher than optimum for the process since a brown product is undesirable.

We claim:

1. A process for imparting wrinkle recovery properties to unmodified cellulosic fabric, the process comprising:

a impregnating a cellulosic fabric to about 100% takeup with a solution containing 50 parts by weight of a cyclic carbonate selected from the group consisting of ethylene carbonate and propylene carbonate, 50 parts by weight of diethylene glycol, and 1 part by weight of a dibasic acid soluble in the glycolcarbonate mixture, b placing the wet impregnated fabric in a vacuum oven preheated to about from 160° to 180°C, c evacuating the oven to obtain a pressure of about 35 mm of Hg, d maintaining the temperature of (b) and the pressure of (c) for a reaction time of about from 30 to 120 minutes, and e washing the reacted fabric with water to remove unreacted material.

2. The process of claim 1 wherein the cyclic carbonate is ethylene carbonate.

3. The process of claim 1 wherein the cyclic carbonate is propylene carbonate.

4. The process of claim 1 wherein the dibasic acid is malonic acid.

* * * * *